United States Patent [19]

Adler

[11] 4,043,273

[45] Aug. 23, 1977

[54] ALTERNATIVELY USABLE SLING AND KEY ROLLER BEARING RETAINERS

[75] Inventor: Franklin P. Adler, Michigan City, Ind.

[73] Assignee: Pullman Transport Leasing Company, Chicago, Ill.

[21] Appl. No.: 631,756

[22] Filed: Nov. 13, 1975

[51] Int. Cl.[2] ..... B61F 5/26; B61F 5/52; B61F 15/2; B61F 15/20

[52] U.S. Cl. ..... 105/221 R; 105/221 K

[58] Field of Search ..... 105/81, 218 R, 220, 105/221 R, 221 K, 224 R

[56] References Cited

U.S. PATENT DOCUMENTS

| | | | |
|---|---|---|---|
| 253,439 | 2/1882 | Smith | 105/218 R X |
| 1,229,617 | 6/1917 | Howard | 105/221 R |
| 1,640,180 | 8/1927 | Buckwalter | 105/220 X |
| 1,724,798 | 8/1929 | Hankins et al. | 105/218 R |
| 2,165,662 | 7/1939 | Swan | 105/81 |
| 2,234,413 | 3/1941 | Orr | 105/221 K |
| 2,424,327 | 7/1947 | Nystrom et al. | 105/221 K |
| 2,880,680 | 8/1959 | Quinn | 105/224 R |
| 3,091,192 | 5/1963 | Cope | 105/221 R |
| 3,110,269 | 11/1963 | Lusink et al. | 105/221 R |

*Primary Examiner*—Robert J. Spar
*Assistant Examiner*—Howard Beltran
*Attorney, Agent, or Firm*—Richard J. Myers

[57] ABSTRACT

A pedestal type side frame for a railway truck selectively having a sling type axle bearing retainer and a key-type axle bearing retainer. The pedestal includes a pair of depending legs defining a downwardly opening jaw for receiving an axle roller bearing. Each leg includes a transversely chambered portion and one of the legs includes a transverse ledge spaced below the associated chambered portion; whereby, an axle roller bearing is entrapped within the pedestal jaw by said sling having its ends anchored within said chambered portions and by said key-type retainer cantilevered substantially beneath the bearing from said ledge.

5 Claims, 8 Drawing Figures

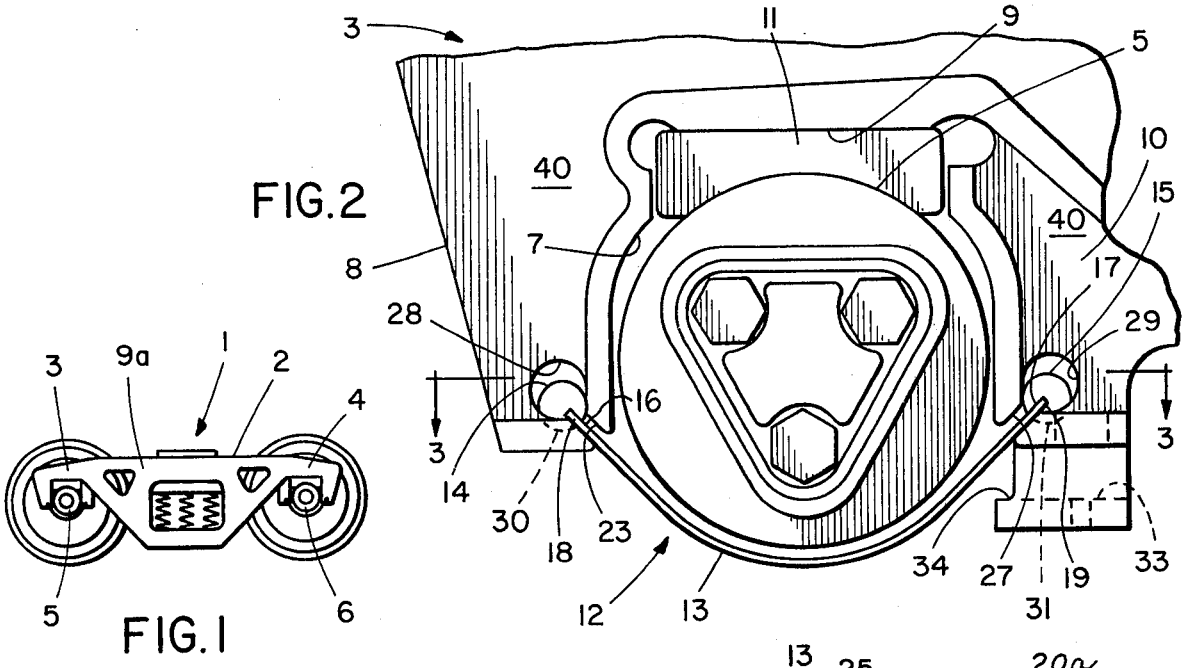
FIG.2
FIG.1
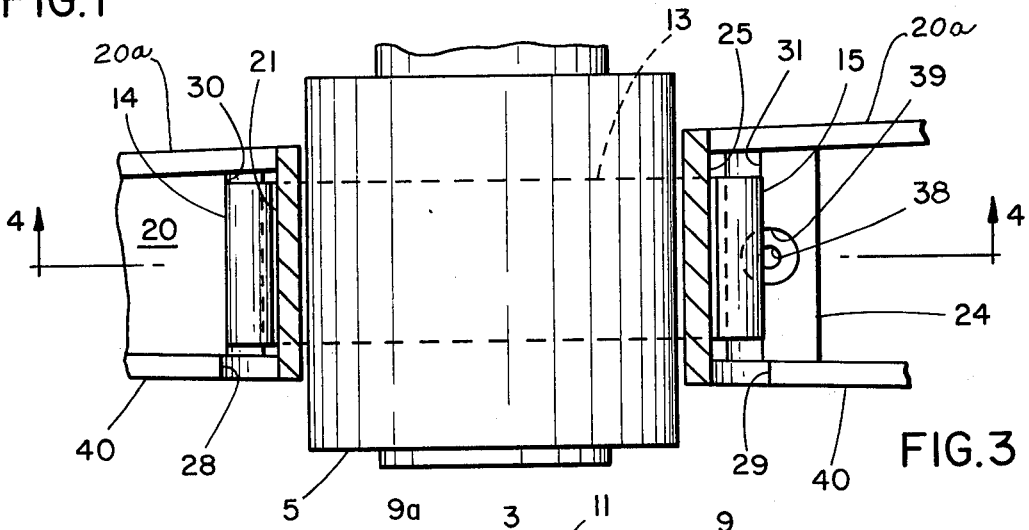
FIG.3
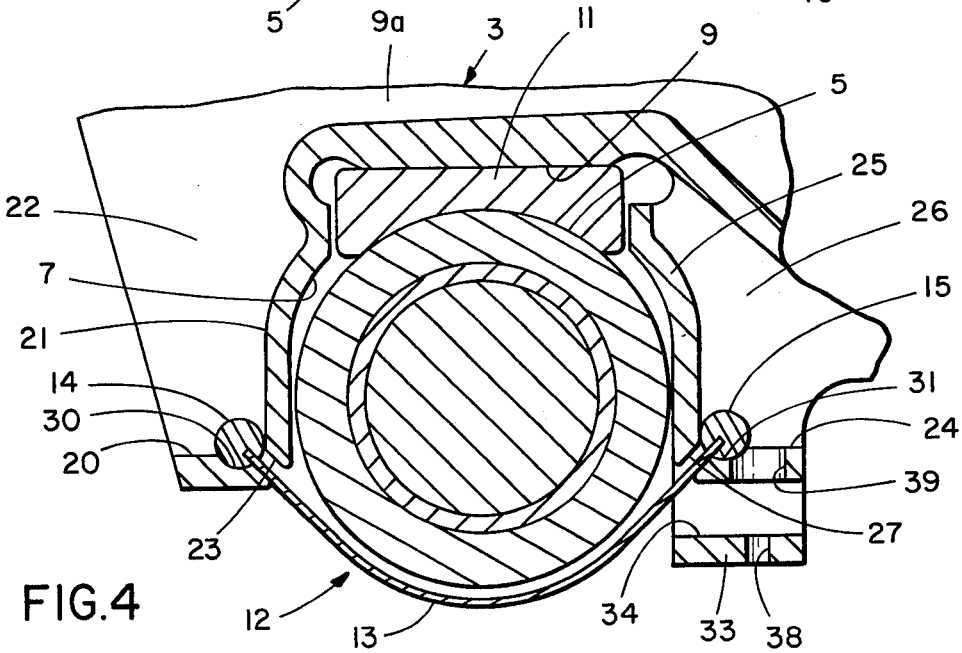
FIG.4

ALTERNATIVELY USABLE SLING AND KEY ROLLER BEARING RETAINERS

BACKGROUND OF THE INVENTION

1. Field of the Invention

This invention relates to wheel axle bearing retaining means for a railway truck having pedestal-type frames.

2. Description of the Prior Art

In a railway truck having a pair of pedestal type side frames supported on the wheel axles through roller or cartridge type axle bearings carried within inverted U-shaped pedestal jaws provided in the side frames, it is necessary to entrain the bearings within the jaw to limit their vertical movement relative to the side frames. This is particularly important if a railway car derails to minimize the danger zone surrounding the wreck by preventing the car's wheel and axle assemblies from flying free of the car. Additionally, by insuring that the wheel axles remain secured to their respective car trucks, structural damage to the car is minimized.

In the past, a variety of structures have been developed to entrain the bearings within the truck side frames. For example, one means has been to provide a horizontally extending rigid retaining bar beneath each bearing. The respective ends of the bar are secured or entrained by the opposing lower pedestal jaw portions. One end of the retaining bar is pivotally entrained on one side of the pedestal jaw and its other end is secured to the other side of the jaw with bolts or similar means. See U.S. Pat. Nos. 1,724,798; 2,424,327; and 3,110,269.

Although a side frame incorporating rigid retaining bars does entrain the axle bearings within the side frame jaws, the manner in which the retaining bar is secured by the jaws substantially limits its useful service life. More particularly, the rocking of a moving railway car will cause downward oscillatory impact loading by the bearing on the retainer bar. This causes the bar to tend to pivot about its pivoted end and to stretch and loosen the bolt securing the other end of the bar. Consequently, since once the bolt is stretched it is generally impossible to tighten it to resecure the bar, it is necessary to discontinue use of the car until the bolt or both the bar and bolt are replaced. Clearly, during the useful life of a rail car this can result in a substantial maintenance expense and increased costs associated with the non-availability of the car.

Another means of restraining vertical movement of an axle bearing has been to secure a cantilevered key-type retaining member in one of the pedestal jaw portions with a bolt or similar means. See U.S. Pat. Nos. 1,229,617 and 3,091,192. This design provides for the key member to extend partially beneath the bearing to entrap it within the downwardly opening or inverted U-shaped jaw. However, during extended use the key must endure substantial bending as well as shear loads which are imposed on the key-type retainer by the downward oscillatory movement of the bearing. Such loading on the key-type retainer could result in it being bent to such an extent that it becomes wedged in the jaw and therefore difficult to remove for repair or replacement as well as stretching and consequently loosening the bolt which secures the retainer to the jaw portion.

U.S. Pat. Nos. 253,439 and 1,640,180 illustrate bands for securing the axle bearings in the jaws. The band in the U.S. Pat. No. 253,439 is secured by a pin at one end and a bolt at the other end which pass through aligned apertures in the frame and strap which weaken the strap. In U.S. Pat. No. 1,640,180 a resilient strap is used which at its ends is secured by transverse pins to the spaced jaw elements which may easily shake loose and provide a construction imposing high stresses in the areas of connection of the pins to the ends of the strap. The strap is thin and lays against the external side of the frame.

In addition to the above, vibration of the trucks during normal rail operations tends to loosen the bolts securing either the retaining bar, the key-type retainer, bands or sling-type retainers.

SUMMARY OF THE INVENTION

The present invention discloses a wheel axle bearing retaining means for a railway truck having pedestal-type side frames.

The invention provides that the pedestal jaws of the side frames each include means of selectively securing a key-type bearing retainer and a sling-type bearing retainer within the respective pedestal jaw. The sling-type retainer includes a wide flexible strap having its ends secured within the opposing faces of each pedestal jaw and extending below the bearing to entrap it within the jaw. The sling retainer is particularly adapted for installation and removal while the car is in field service without the use of any tools or special maintenance equipment. Additionally, in the event a sling-type retainer is not available at a field car maintenance facility, a key-type bearing retainer can be secured in a key slot provided in one of the legs of the jaw to entrap the bearing within the jaw.

It is therefore an object of the present invention to provide a sling-type roller bearing retainer means in a railway truck having pedestal-type side frames supported on the wheel axles through roller or cartridge type axle bearings.

It is another object to include means of selectively securing a key-type bearing retainer and a sling-type bearing retainer within each pedestal jaw of the side frames of a railway truck.

It is another object to provide a sling-type roller bearing retainer of the foregoing character which uniformly distributes the downward loading on the roller bearing retainer between the downstanding legs defining a jaw of a truck pedestal.

It is another object to provide a sling-type roller bearing retainer of the foregoing character which may be installed or removed without the use of any tools while the railway car is in field service.

It is a further object to provide a novel retainer wherein the sling is a flat strap which at its ends extends radially of the securing pins to optimize the connection between the pins and strap along an extensive length of each pin and the full width of the strap.

These and other objects will become apparent from reference to the following description, attached drawing and appended claims.

BRIEF DESCRIPTION OF THE DRAWINGS

FIG. 1 shows a side elevation view of a railway truck having a pedestal type side frame and roller bearings carrying the wheel axles;

FIG. 2 is an enlarged view of the leftmost pedestal shown in FIG. 1 showing the sling-type bearing retainer installed on the railway truck and thereby entrapping the axle roller bearing within the truck pedestal jaw;

FIG. 3 is a plan section shown at line 3—3 in FIG. 2;

FIG. 4 is a side sectional elevation view shown at line 4—4 in FIG. 3;

DESCRIPTION OF THE PREFERRED EMBODIMENT

Figure 5:
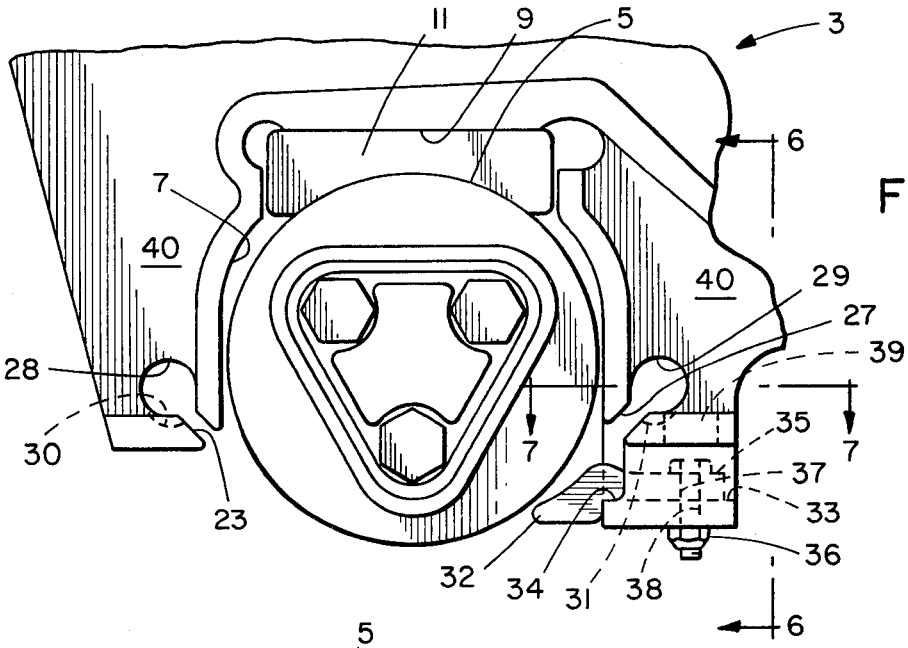
FIG. 5 is the same view of the side frame shown in FIG. 2 having a key-type bearing retainer installed in it.

With reference to FIG. 1, there shown is a pedestal-type railway truck 1 having a side frame 2. The side frame 2 includes pedestals 3 and 4 which carry roller bearings 5 and 5, respectively. As more clearly shown in FIG. 2, the pedestal 3, which is of generally the same construction as the pedestal 4, includes a downwardly opening jaw 7 defined by an outer vertical leg or ear 8, an upper or top horizontally disposed wall 9 at the bottom of the box section compression member 9*a*, an inner vertical leg or ear 10. Additionally, a conventional saddle or adaptor 11 is provided adjacent the upper wall 9 to restrain lateral movement of the roller bearing 5 in the conventional manner.

To restrain downward movement of the axle roller bearing 5, the invention provides a roller bearing retainer sling 12 extending below and substantially adjacent the bearing and having its ends entrappingly secured within the lower portions of the pedestal jaw 7. The retainer sling 12 includes a wide flexible strap 13 slightly less than the space between the inner and outer vertical walls of the legs of the jaw. Retainer bars 14 and 15 secured to respective ends 16 and 17 of the strap 13, the strap ends extending into radial slots 18 and 19 in the bars 14 and 15 and being connected thereto by welding or other well known means.

As more clearly indicated in FIGS. 3 and 4, the roller bearing retainer sling 12 is supported from the pedestal 3 between legs 8 and 10 and removably secured therein by the retainer bars or entrapable ends 14 and 15. The leg or ear 8 includes a horizontal transversely extending retaining ledge or saddle 20 at the bottom of the leg and an upwardly transversely extending restraining wall 21 which with inboard and outboard walls 20*a* and 40 define an enlarged chamber 22. The inner edge of wall 20 and lower edge of wall 21 are spaced apart and define an upwardly diagonal sling access slot 23. Similarly, the leg or ear 10 is provided with retaining ledge 24 above the lower end of leg 10, an upward restraining wall 25 and the inboard and outboard pedestal walls 20*a* and 40 which define an enlarged chamber 26 and the inner edge of ledge 24 and the lower edge of wall 25 define an upwardly diagonal sling access slot 27 opposing slot 23 across the jaw. The slots 23 and 27 each extend divergingly diagonally upwardly to retainer bar access apertures or openings 28 and 29 in the outboard pedestal wall 40, respectively, and transversely extending channels or troughs 30 and 31 are provided in the retaining ledges 20 and 24 adjacent the slots 23 and 27. This construction provides that the retainer sling 12 may be installed on the pedestal 3 by simultaneously inserting the retainer bars 14 and 15 through the apertures 28 and 29 and the strap 13 into the slots 23 and 27. By this means the retaining bars are placed in the channels 30 and 31 so that the restraining wall 21 and retaining ledge 20 cooperate to capture the bar 14, and the restraining wall 25 and retaining ledge 24 cooperate to capture the bar 15 to secure the sling 12 in the bearing retaining position.

The invention further provides means to prevent loss of the sling during rail operations. More particularly, the access openings 28 and 29 are spaced above the channels 30 and 31 such that when the retainer bars 14 and 15 are placed in the channels 30 and 31, both bars are restrained against outboard movement by the inboard face of the pedestal wall 40. Additionally, the diameters of the access openings 29 and 30 are but slightly larger than those of the retainer bars 14 and 15. Thus, by painting the peripheral edges of each opening, their diameters are reduced such that the retaining bars cannot be withdrawn from the pedestal without scraping off or otherwise removing the paint.

Figure 7:
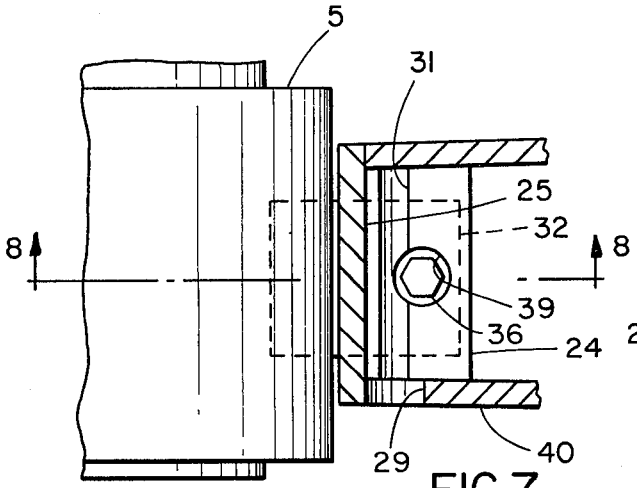
FIG. 7 is the plan section shown at line 7—7 in FIG. 5.
Figure 6:
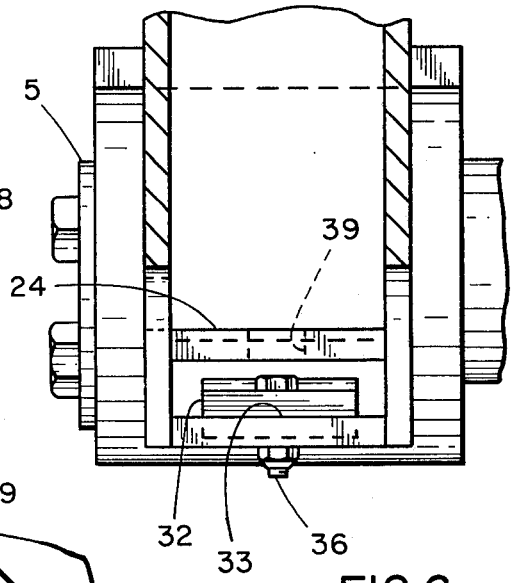
FIG. 6 is the elevational section shown at line 6—6 in FIG. 5.
Figure 8:
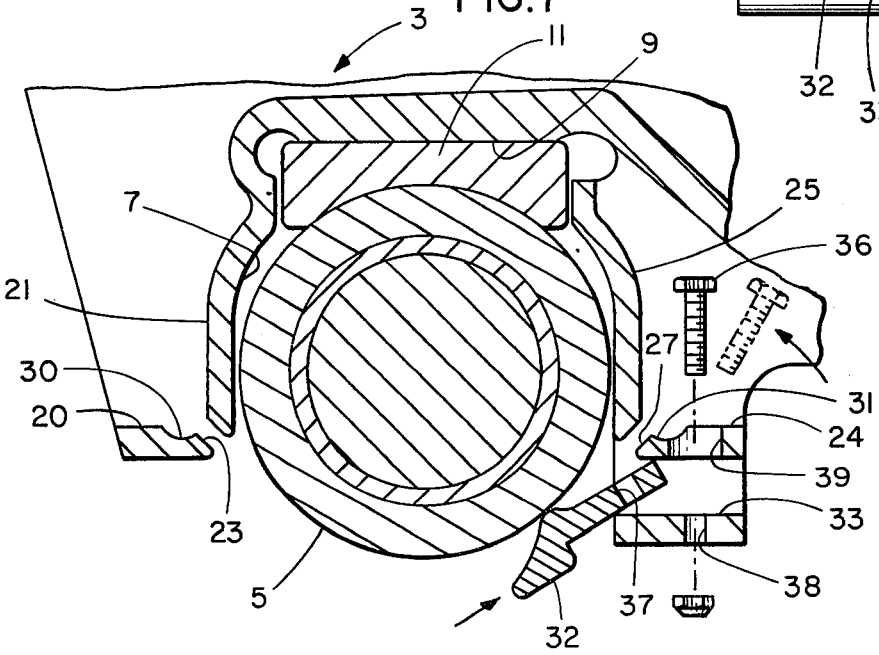
FIG. 8 is a side sectional elevation view shown at line 8—8 of FIG. 7 which illustrates the method of installing a key-type retainer in the side frame.

The structure of the pedestal 3 further includes a keyway or means of securing a conventional cantilevered key-type bearing retainer or key 32 within the jaw 7 in the event a sling 12 is not available or not desired as most clearly shown in FIGS. 5-8. A horizontal bottom ledge portion 33 is provided on the inner leg or ear 10 below ledge 24 which is coplanar with ledge 20 of opposing leg 8. Ledge 33 is accessible from the bearing 5 through a cutout portion 34 in the leg 10. To secure the key 32 to the leg 10, the attachment portion 35 of the key 32 may be inserted through the cutout 34 in wall 40 and secured to the ledge 33 by nut and bolt means 36 which extends through holes 37 and 48 provided in the key 32 and ledge 33, respectively. Additionally, an access hole 39 is provided in retaining ledge 24 to facilitate installing the nut and bolt means 36 in the manner illustrated in FIG. 8.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

What is claimed is:

1. In pedestal type side frame for a railway truck including an inner and outer depending legs spaced lengthwise of the frame forming, a downwardly opening jaw for receiving an axle bearing, each of said legs having a portion including a ledge and defining a enlarged chamber delineated by the ledge and a reduced slot opening into said jaw from said chamber, said inner leg having a transverse bottom ledge portion spaced below said ledge of said chamber and opening into said jaw, an elongated sling having enlarged inner and outer ends, means anchoring said ends to said leg portions within the chambers therein, adapted to be secured to said bottom ledge portion for selectively retaining the bearing within said jaw, said sling extending through said slots and across said jaw below the bearing, and said inner leg having a passage being formed between said ledges adapted to receive a bearing retaining key.

2. In pedestal type side frame for a railway truck including an inner and outer depending legs spaced lengthwise of the frame forming, a downwardly opening jaw for receiving an axle bearing, each of said legs having a portion including a ledge and defining an enlarged chamber delineated by the ledge and a reduced slot opening into said jaw from said chamber, said reduced opening adapted to receiving a bearing retaining sling, said inner leg having a transverse bottom ledge portion spaced below said ledge of said chamber and opening into said jaw, said inner leg having a passage being formed between said ledges to receive a key, and a key in the passage being secured to said ledge and being cantilevered from said ledge below the lower proximity of the bearing.

3. In a pedestal type side frame for a railway truck including an inner downstanding leg and an outer downstanding leg defining a downwardly opening jaw for receiving an axle bearing, an improved roller bearing retainer comprising:

a enlarged chamber in each of said legs formed by a downstanding restraining wall, a trough-like transverse retaining ledge and vertical inboard and outboard pedestal walls, one of said walls having a bar-receiving aperture, said restraining wall and retaining ledge forming an access slot extending between the inboard and outboard walls from the respective aperture and chamber diagonally from the jaw toward a vertical plane passing through the axle bearing, an elongated retainer sling having a flexible strap with elongated retainer bars extending widthwise of the sling and secured to each end, said sling having its end insertable with respective retainer bars through each aperture into its respective chamber by moving the sling horizontally inward into the respective access slots through respective apertures, said bars being seated along their entire lengths in the troughs, and said sling being disposed below the axle bearing and having substantially straight portions extending diagonally through respective slots into the jaw below the axle bearing in position for loading entirely in tension to resist forces tending to separate the axle from the side frame.

4. The invention according to claim 3, and said apertures being located above the trough-like ledge such that when the sling is in its installed position the outboard wall provides abutments for the retaining bars preventing horizontal exit of the retainer bars through respective apertures.

5. The invention according to claim 4, and said lateral apertures being dimensioned slightly greater than the modal dimensions of the enlarged end portions and adapted to be coated with adherent materials about their margins to reduce said dimensions to less than that of the end portions to inhibit removal thereof.

* * * * *